US006352333B2

(12) United States Patent
Matsumoto et al.

(10) Patent No.: US 6,352,333 B2
(45) **Date of Patent: *Mar. 5, 2002**

(54) METHOD AND APPARATUS FOR PREVENTING NOZZLE CLOGGING IN INK JET PRINTING APPARATUS

(75) Inventors: Shuzo Matsumoto; Takeo Murai; Mitsumi Fujii, all of Yokohama (JP)

(73) Assignee: Ricoh Company Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/233,574

(22) Filed: Jan. 19, 1999

(30) Foreign Application Priority Data

Jan. 19, 1998 (JP) ..... 10-008107

(51) Int. Cl.[7] ..... B41J 2/165
(52) U.S. Cl. ..... 347/23; 347/35
(58) Field of Search ..... 347/35, 36, 24, 347/23, 22

(56) References Cited

U.S. PATENT DOCUMENTS 4,947,190 A * 8/1990 Mizusawa et al. ..... 347/33
4,967,204 A * 10/1990 Terasawa et al. ..... 347/35 X
5,040,000 A * 8/1991 Yokoi ..... 347/30
5,194,903 A * 3/1993 Negishi et al. ..... 399/384
5,280,299 A * 1/1994 Saikawa et al. ..... 347/87
5,467,114 A 11/1995 Ebinuma et al.
5,552,812 A 9/1996 Ebinuma et al.
5,760,802 A 6/1998 Ebinuma et al.
5,856,835 A * 1/1999 Umeda et al. ..... 347/23
5,877,782 A * 3/1999 Imai et al. ..... 347/23 X

FOREIGN PATENT DOCUMENTS

| | | | |
|---|---|---|---|
| JP | 63-299940 | * 12/1988 | ..... B41J/3/04 |
| JP | 6-15815 | 1/1994 | |
| JP | 06134997 | * 5/1994 | ..... B41J/2/165 |
| JP | 7-47679 | 2/1995 | |
| JP | 7-81085 | 3/1995 | |

* cited by examiner

*Primary Examiner*—David F. Yockey
(74) *Attorney, Agent, or Firm*—Greenberg Traurig, LLP

(57) ABSTRACT

An ink-jet printing apparatus and method in which a head unit having at least one nozzle ejects ink drops on demand, a sheet transporting path disposed below the head unit transports a sheet through the head unit, and an ink deposit unit disposed below the sheet transporting path is arranged to directly receive ink drops ejected form the nozzle when a nozzle-clog-preventing/ink ejection operation is executed. A controller initiates and stops the nozzle-clog-preventing/ink ejection operation based on whether or not a sheet is detected by sheet detecting elements disposed adjacent to the head unit.

12 Claims, 9 Drawing Sheets

METHOD AND APPARATUS FOR PREVENTING NOZZLE CLOGGING IN INK JET PRINTING APPARATUS

BACKGROUND OF THE INVENTION

1. Field of the Invention

This invention relates to an ink-jet printing apparatus, for example, a full-line-type ink jet printer, a serial-type ink jet printer, and other types of printers, and a method of printing an image on a sheet by ejecting ink drops, and more particularly, the present invention relates to an ink jet printing apparatus and method for preventing an ink clog in one or more nozzles of an ink-jet printing apparatus.

2. Description of Background Art

Ink-jet printing apparatuses for use in a printer, a facsimile, a copier, and other such devices can be generally classified into two types of ink jet printers. The first type is referred to as a serial-type-ink-jet printing apparatus and includes an ink jet head having a nozzle, which head is mounted on a carriage and is capable of printing an image on a sheet by ejecting ink drops during both scanning or movement of the carriage and the attached print head in a main scanning direction and during a sheet movement in a sub scanning direction.

The second type of ink jet printing apparatus is referred to as a line-type-ink-jet printing apparatus and includes an ink jet head having a plurality of nozzles each ejecting ink drops on demand, which head is arranged to extend in a widthwise direction of the sheet to cover almost an entire width of a sheet and which is capable of printing an image on a sheet by ejecting ink drops during transportation of the sheet in a lengthwise direction.

However, when the ink jet head has not been used for a long time (an ink drop has not been ejected from the ink jet head for a long time), and, accordingly, the viscosity of the ink stored in the nozzle is increased due to evaporation of the ink or other conditions, an ejecting operation of ink drops through the nozzle may be deleteriously affected or even prevented due to the occurrence of clogging of the ink in the nozzle. To avoid such a problem, ink jet printing apparatuses generally execute a cleaning procedure in order to prevent nozzle clogging. During the clog-preventing procedure, ink is ejected from the nozzle or nozzles for cleaning or nozzle-clearing purposes and not for the purpose of printing an image on a sheet. Such a nozzle-clog-preventing ink ejecting operation may be performed such that only nozzles which have not ejected ink drops within a predetermined time period have ink ejected therefrom. Alternatively, all of the nozzles regardless whether any of nozzles have ejected ink drops within the predetermined time period, are made to periodically eject ink drops to prevent clogging of the nozzles.

For example, in a serial-type ink jet printer described in Japanese Laid Open Patent Publication Numbers 7-47679/1995 and 7-81085/1995, a nozzle-clog-preventing ink receiving device is provided at a position adjacent to a sheet transportation path so as to receive ink drops in the ink receiving device which ink drops are ejected from nozzles of the ink jet head during a nozzle-clog preventing ink ejection. The carriage having the ink jet head periodically moves to a position above the nozzle-clog-preventing ink receiving device and executes a nozzle-clog-preventing ink ejection. Thereby, a condition of the nozzles for readily and completely ejecting ink drops is obtained without ink being clogged in the nozzles.

Further, in a full-line type ink jet printing apparatus, a nozzle clog preventing ink ejection device is located beside a printing station at which an image is printed, in order to receive ink drops ejected during the nozzle-clog-preventing ink ejection. An ink jet head unit is swung or slid from the printing station so as to be moved to a position above the nozzle-clog-preventing ink ejection device to execute the nozzle-clog-preventing ink ejection into the nozzle-clog-preventing ink ejection device. The head unit then returns to the printing station.

Further, as described in Japanese Laid Open Patent Application Number 6-15815/1994, nozzle-clog-preventing ink ejection is executed such that nozzle-clog-preventing ink is ejected onto a sheet to avoid using an unnecessary nozzle-clog-preventing ink ejection container to minimize an ink jet printer size and to increase a printing speed.

However, in such a full-line type ink jet printer, since the head unit is moved to a position at which nozzle-clog-preventing ink ejection is executed from the printing station, a predetermined time period is required for such a movement of the head unit. Thus, if the nozzle-clog-preventing ink ejection is executed during a printing operation, printing productivity remarkably decreases and the full-line type ink jet printer cannot function as desired as a high speed printer.

Further, a full-line type ink jet printer frequently requires nozzle-clog-preventing ink ejection, since ink drops used therein tend to increase in viscosity due to evaporation thereof. This is because such a full-line-type-ink-jet printer is generally designed to have a printing productivity of from about 30 PPM (prints per minutes) to about 60 PPM, and, accordingly, such a printer generally uses a heater that applies heat to the sheet to improve an adherence of the ink drops to the sheet.

Thus, the above-described problems are more serious in such a full-line type ink jet printer. Further, in a full-color-ink-jet printer including a plurality of heads each ejecting different mono color ink therefrom, which has been recently introduced due to the ease of producing a full color image by mixing a plurality of different single color inks on a sheet, a mechanism used for such a back and forth movement of the head units becomes complex.

To avoid such complexity of the mechanism, nozzle clog preventing ink ejection can be executed directly on a sheet as explained in the above-described serial type ink jet printing apparatus.

However, it is not practical for an ink jet printing apparatus that is generally expected to produce a high quality image, since the sheet receives unnecessary ink drops thereon, and, accordingly, a quality of the image produced on the sheet is greatly lowered.

Further, if nozzle-clog-preventing ink ejection is executed onto a sheet every time after an image is printed on a previous sheet, a plurality of sheets are required to be fed and to receive ink drops ejected during a nozzle-clog-preventing ink ejection, in order to produce an image. As a result, a printing speed is substantially decreased and sheets are wasted.

SUMMARY OF THE INVENTION

To overcome the problems described above, preferred embodiments of the present invention provide an ink-jet printing apparatus that prevents any clogging of ink-jet nozzles while also ensuring rapid printing speed, high quality printed images and avoiding wasted paper and any increase in printer size. Preferred embodiments of the present invention also eliminate the need for moving an ink jet print head to an area outside of a sheet periphery for ejecting ink to prevent nozzle clogging and also avoids the need to use waste sheets of paper for receiving the nozzle-clog-prevention clog-prevention ink ejection drops.

Preferred embodiments of the present invention provide an ink jet printing apparatus including a head unit having at least nozzle arranged to eject ink drops on demand, a sheet-transporting path disposed below the head unit and adapted to transport a sheet through the head unit, and an ink deposit disposed below the sheet transporting path, which is arranged to receive ink drops ejected from the nozzle during a nozzle-clog-preventing ink ejection operation.

It is noted that the ink deposit is disposed in a fixed position below the sheet transporting path and is not moved in order to receive ink drops which are discharged during a nozzle-clog-preventing ink ejection operation. Furthermore, it is noted that the head unit and the ink deposit are arranged such that the ink deposit is open and exposed to the at least one nozzle of the head unit except when paper is fed between the at least one nozzle and the ink deposit during a printing operation.

The ink deposit may preferably comprise a recess formed in a printing apparatus body directly under the print head unit. The recess as noted above is preferably uncovered and exposed to the ink jet nozzles of the ink jet head. The recess preferably includes a bottom wall and side walls connected to the bottom wall. The bottom wall and side walls may preferably form a substantially rectangular recess. Alternatively, one or more of the bottom wall and the side walls may have an uneven inner surface in order to provide sufficient air cavities in the ink deposit as explained later.

The recess of the ink deposit can include an opening larger than a cross section of the ink jet head unit in both a width direction and a length direction thereof. In such a case, sheet guides are provided at sides of the ink deposit for ensuring that a paper to be printed is securely guided above the recess of the ink deposit and so as to prevent edges of the paper from entering into the recess of the ink deposit.

Further, the ink jet printing apparatus can include an ink-absorbing member capable of absorbing ink drops ejected from a head unit. The ink absorbing member is located in the ink deposit. The ink-absorbing member can be made of porous material or other suitable material. When such an ink absorbing member is used, at least one or more of the bottom wall and the side walls have uneven inner surfaces to define air gaps or spaces between the ink-absorbing member and the bottom wall and the side walls to provide sufficient air in the recess of the ink deposit so as to allow the ink absorbing member to remain absorbent and to allow for ink which has been absorbed by the ink-absorbing member to be evaporated.

In an embodiment wherein no ink-absorbing member is provided, the bottom wall and side walls may or may not have uneven surfaces but they preferably include one or more holes for draining the ink contained in the ink deposit to an ink reservoir for recycling or removing ink from the ink deposit.

Further, the ink jet printing apparatus can include an ink-removing device capable of removing ink deposited in the ink deposit. Such an ink removing device may comprise a suction mechanism for removing the ink from the ink deposit via suction. Other suitable ink removing devices may also be provided. The ink jet printing apparatus can include an ink-removing controller that controls an ink-removing device to periodically remove the ink from the ink deposit.

Further, the ink jet head unit can be arranged such that an ink-ejecting surface thereof is directed downward such that ink drops ejected from the ink jet head are ejected in a downward direction. Further, the ink-jet-printing apparatus can include a pair of sheet detectors, each of which is respectively disposed upstream and downstream of a head unit and each of which is capable of detecting a leading edge and a trailing edge of a sheet, respectively, and an ink jet head unit operating controller capable of controlling the head unit in such a manner that the head unit executes nozzle-clog-preventing ink ejection when each of the pair of sheet detectors does not detect the sheet.

The ink jet printing apparatus can include an ink jet head unit having a single ink jet nozzle for printing only one color ink, such as black ink. Alternatively, the ink jet printing apparatus can include an ink jet head have any number of ink jet nozzles including a plurality of color ink heads or nozzles each ejecting a different mono color ink drops from its nozzle(s).

Other features, advantages, elements and modifications of preferred embodiments of the present invention will become more apparent from the detailed description of the present invention below.

BRIEF DESCRIPTION OF THE DRAWINGS

A more complete appreciation of the present invention and many of the attendant advantages thereof will be readily obtained as the same becomes better understood by reference to the following detailed description of preferred embodiments when considered in connection with the accompanying drawings, wherein.

DETAILED DESCRIPTION OF PREFERRED EMBODIMENTS

A plurality of preferred embodiments of the present invention are explained referring to the attached drawings. Hereinafter, like numeral numbers indicate identical or corresponding parts throughout several views to avoid repetition.

Figure 1:
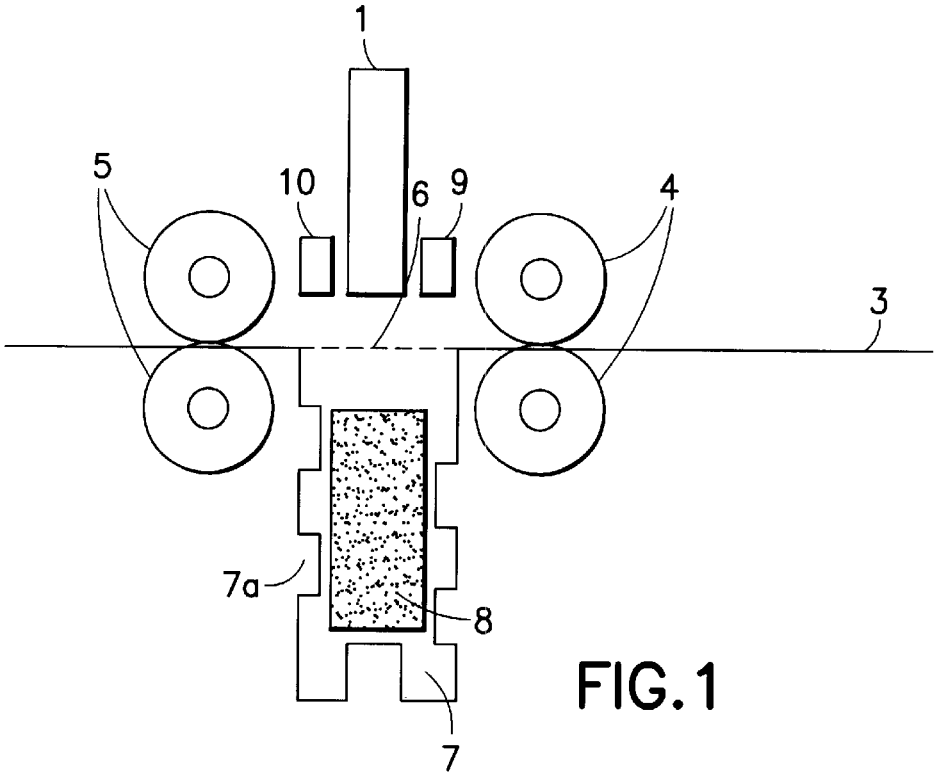
FIG. 1 a schematic cross-sectional view of an ink jet printing apparatus according to a preferred embodiment of the present invention.
Figure 2:
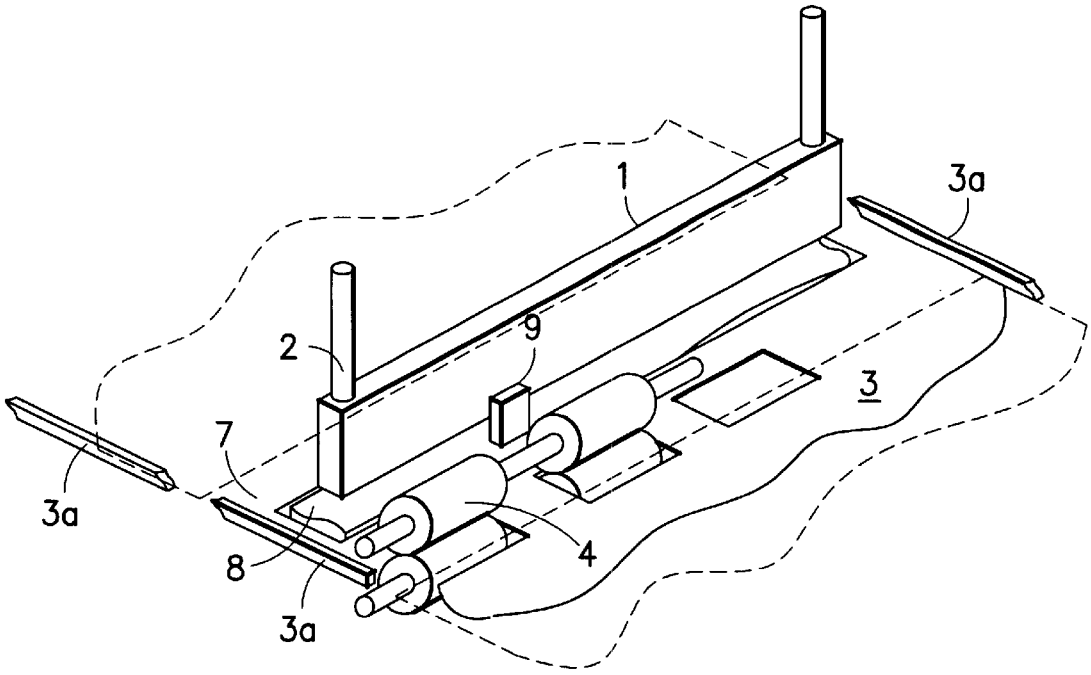
FIG. 2 schematic perspective view of the ink jet printing apparatus illustrated in FIG. 1.
Figure 3:
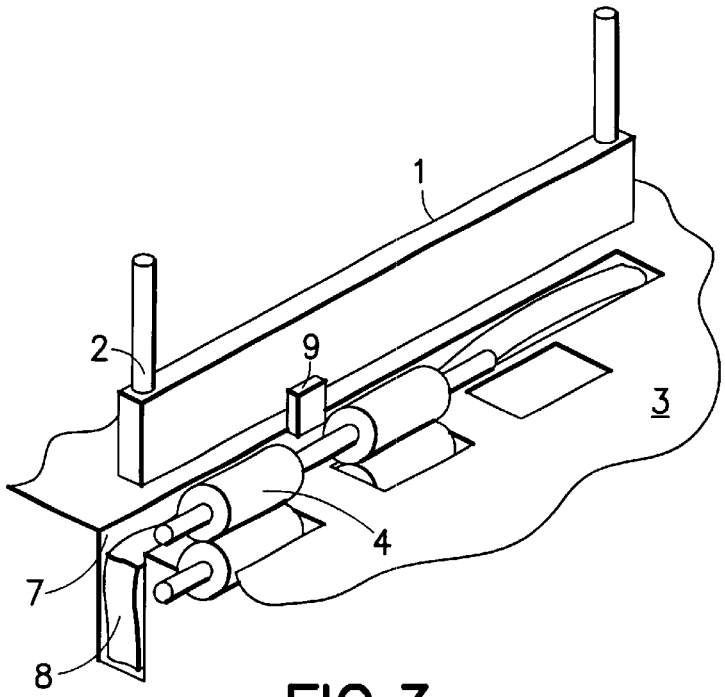
FIG. 3 is a schematic perspective view of the ink jet printing apparatus illustrated in FIG. 1.

A mechanism of an ink jet printing apparatus according to a preferred embodiment of the present invention is illustrated in FIG. 1. Perspective views of the ink jet printing apparatus illustrated in FIG. 1 are illustrated in FIGS. 2 and 3. The ink jet printing apparatus according to the preferred embodiment shown in FIGS. 1–3 includes an ink jet head unit 1 having only one print head arranged in a sheet transporting direction. The ink jet head unit 1 includes a plurality of nozzles arranged widthwise of a sheet to be transported as seen in FIG. 2. The head unit 1 is disposed above a sheet-transporting path at a printing station with its ink drop surface facing in a downward direction. An ink supply tank (not shown) that stores ink is provided and supplies mono color ink to the one head through ink supplying pipe 2 shown in FIG. 2.

A sheet guide 3 is disposed below the ink jet head unit 1 so as to guide and allow transportation of the sheet 6 along a sheet-transporting path. It is noted that in the preferred embodiment shown in FIG. 2, an auxiliary sheet guide 3*a* may be provided at outer edges of the sheet path and arranged to extend across an area where an ink deposit 7, described later, is located. The auxiliary sheet guide 3*a* and sheet guide 3 provide a secure feeding of a sheet 6 to and from the ink jet head unit 1 without the paper being misfed.

A pair of transporting rollers 4 is disposed upstream of and adjacent to the printing station to transport the sheet 6 toward the printing station where the ink jet head unit 1 is located. A pair of ejecting rollers 5 is disposed downstream of and adjacent to the printing station to transport the sheet 6 downstream after the sheet has been printed.

An ink deposit 7 is disposed below the sheet-transporting path and is disposed opposite to the head unit 1. The ink deposit 7 is preferably stationary and does not move relative to the ink jet head unit 1 or the sheet feeding path. The ink deposit 7 preferably includes a recess arranged to receive ink ejected from the nozzles during a nozzle-clog-preventing ink ejection operation of the head unit 1. The ink deposit 7 preferably has an opening that is larger than a cross section of the ink jet head unit 1. The ink deposit 7 does not interfere with either sheet transportation or a separation of the sheet from the ink ejecting surface of the head 1 by a distance of about 1 mm, for example.

Uneven surfaces 7*a* may be formed either on a side wall or a bottom wall of the ink deposit 7, or both the side walls and bottom wall. In such a case, an ink absorbing member 8 capable of absorbing ink drops is preferably provided in the recess of the ink deposit 7. As seen in FIG. 1, when the ink absorbing member 8 is disposed in the recess 7 having uneven portions 7*a* on the side walls or bottom wall, the ink absorbing member is spaced from the side walls and bottom wall and air pockets are formed between the ink absorbing member 8 and the recess 7 to allow the ink absorbing member 8 to function properly and absorb ink. The ink absorbing member 8 is preferably made of multi porous material such as urethane-foam, and other suitable absorbent materials. The ink absorbing member 8 can have a size that is approximately equal to the recess of the ink deposit 7, or can be mounted only on the side wall or bottom wall of the ink deposit 7.

Further, the ink absorbing member 8 can be omitted. In such a case, the uneven portions 7*a* of the side walls or bottom wall can be included or omitted. Also, if the ink absorbing member 8 is omitted, a hole or holes leading to an ink reservoir for gathering ink from the ink deposit 7 may be provided in the bottom wall or portions of the side walls.

A sheet detecting device including a pair of sheet detectors 9 and 10 capable of detecting a sheet which may be respectively disposed upstream and downstream of the head unit 1. The pair of sheet detectors 9 and 10 can comprise optical detectors that optically detect a sheet or mechanical detectors that mechanically detect a sheet. Other suitable sheet detectors may also be provided. For example, a controller and timing switch may be operatively connected so as to determine exactly when a sheet has left or arrived at any location along the sheet path so as to determine when a sheet is not positioned between the ink jet head unit 1 and the ink deposit 7 such that a nozzle-clog-prevention ink ejection can be executed.

Figure 4:
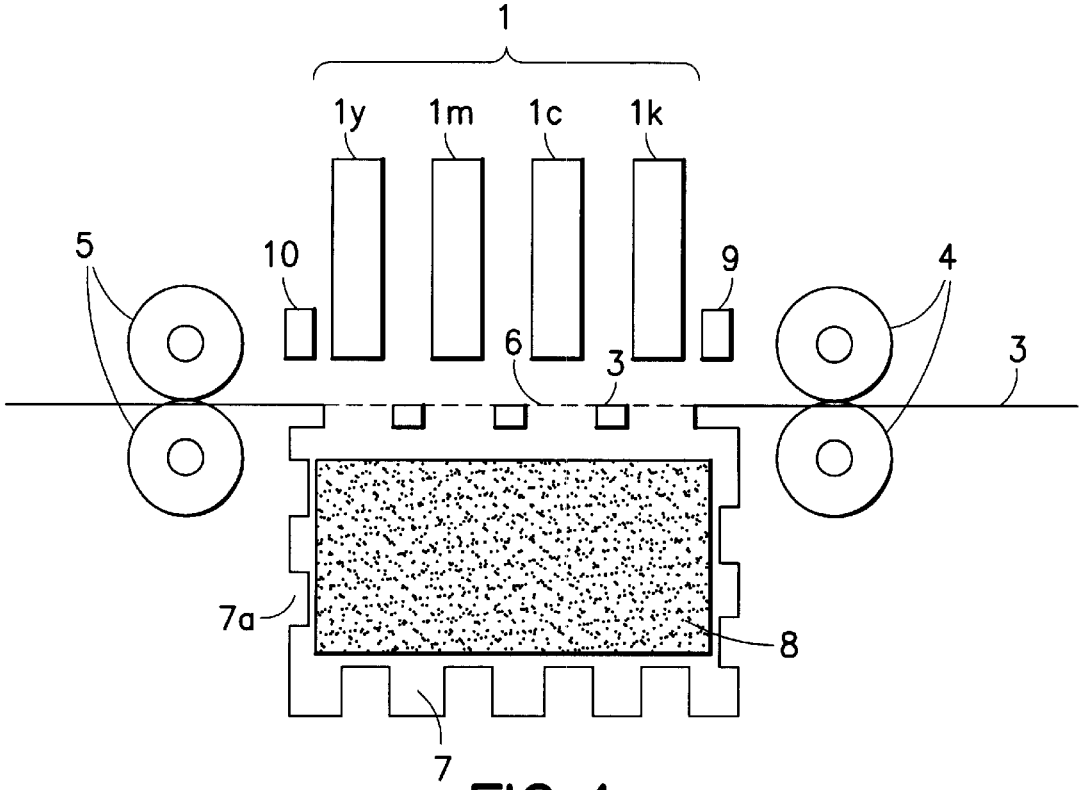
FIG. 4 is a schematic cross-sectional view of an ink jet printing apparatus according to an additional preferred embodiment of the present invention.
Figure 5:
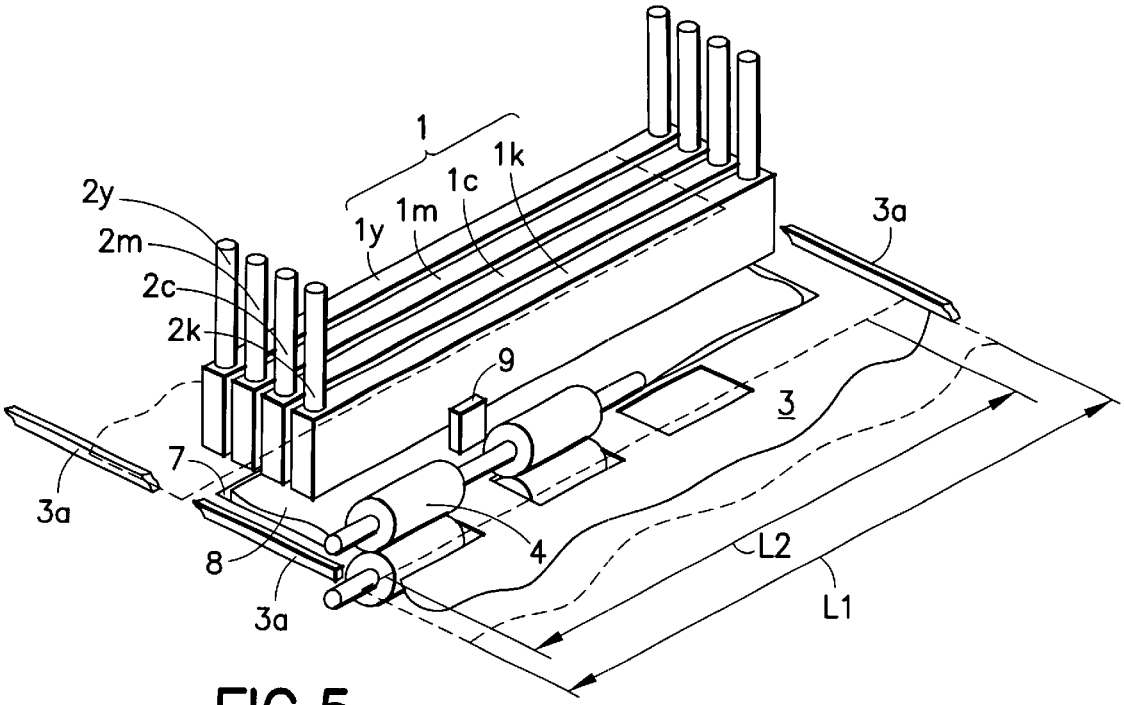
FIG. 5 is a schematic perspective view of the ink jet printing apparatus illustrated in FIG. 4.

FIGS. 4 and 5 show another preferred embodiment of the present invention in which an ink jet printing apparatus includes a plurality of ink jet print heads. Otherwise, the structure shown in FIGS. 4 and 5 substantially corresponds to that shown in FIGS. 1 and 2 as indicated by like reference numerals.

The ink jet head unit 1 of the ink jet printing apparatus shown in FIGS. 4 and 5 preferably includes at least 4 kinds of heads 1*k*, 1*c*, 1*m* and 1*y* each arranged in a sheet transporting direction in this order and each including a plurality of nozzles arranged widthwise of the sheet 6 to be transported. The four kinds of ink jet heads 1*k*, 1*c*, 1*m* and 1*y* preferably eject black, cyan, magenta and yellow ink, respectively, onto the sheet 6 on demand. An ink storing tank (not shown) that separately stores a plurality of kinds of mono color ink therein is provided and supplies mono color ink to one of the four heads 1*k*, 1*c*, 1*m* and 1*y* through a corresponding one of ink supplying pipes 2*k*, 2*c*, 2*m* and 2*y*, respectively.

As seen in FIG. 5, the ink deposit 7 preferably has a width that is substantially equal to a distance L2 and auxiliary guides 3*a* are located at a distance L1 apart from each other, wherein the distance L1 is greater than the distance L2.

Figure 6:
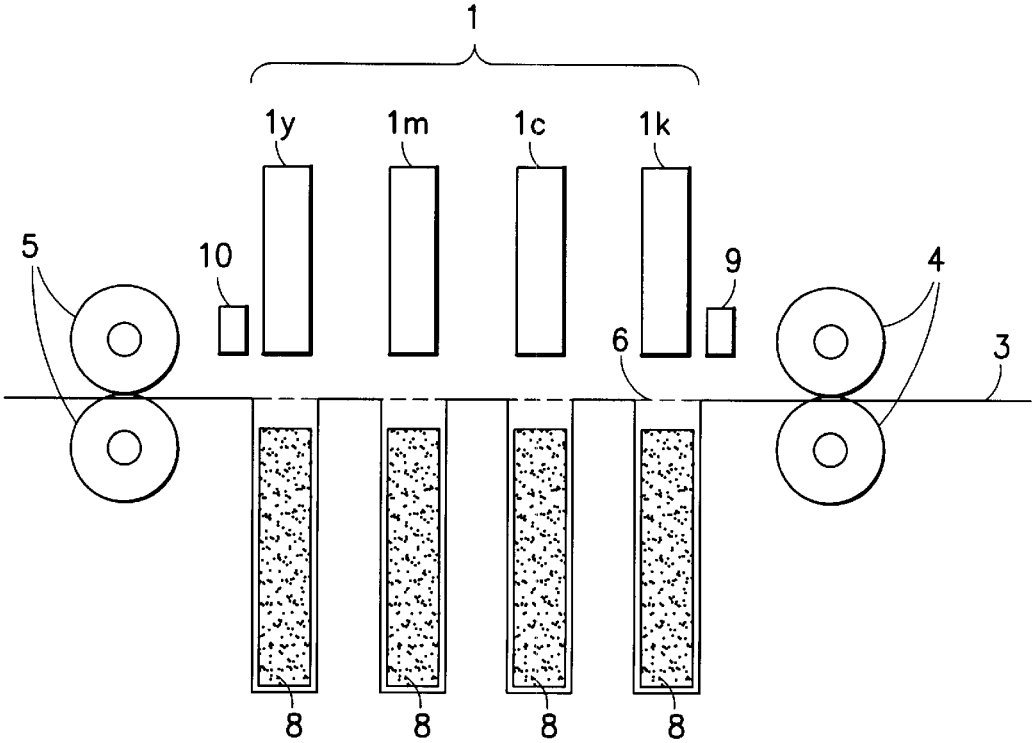
FIG. 6 is a schematic cross-sectional view of an ink jet printing apparatus according to an alternative preferred embodiment of the present invention which is a modification of the apparatus shown in FIG. 4.
Figure 7:
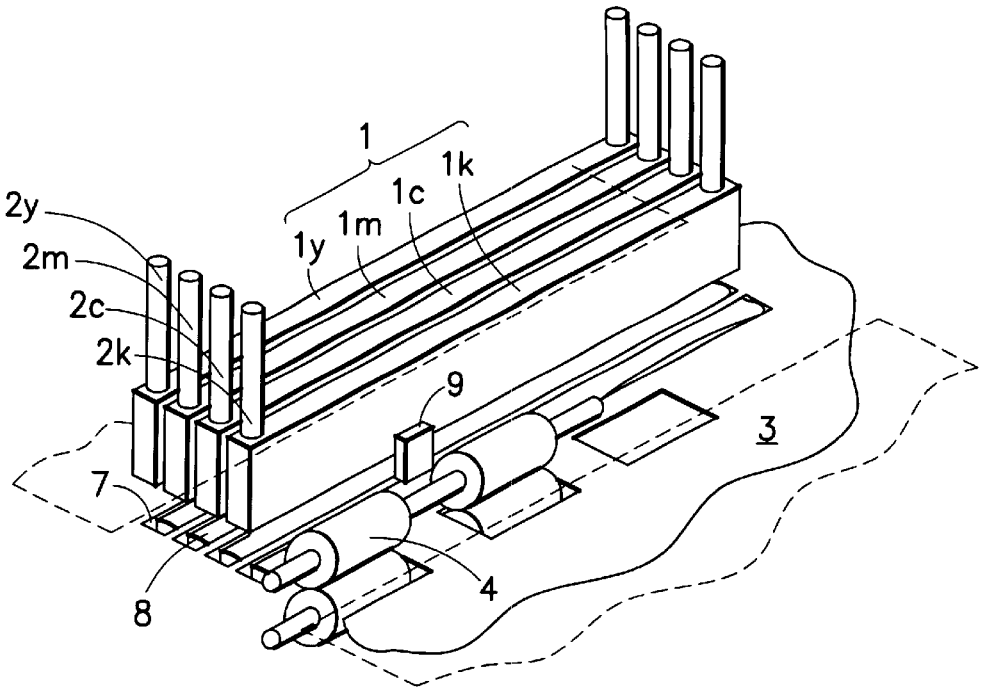
FIG. 7 is a schematic perspective view of the ink jet printing apparatus illustrated in FIG. 6.

FIGS. 6 and 7 shows an alternative embodiment of the preferred embodiment shown in FIGS. 4 and 5. As seen in FIGS. 6 and 7, instead of providing just one ink deposit 7 and just one ink absorbing member 8 shown in FIGS. 4 and 5, there are a plurality of ink deposits 7*k*, 7*c*, 7*m* and 7*y* and preferably, a plurality of ink absorbing members 8*k*, 8*c*, 8*m* and 8*y* disposed in receptive ones of the ink deposits 7*k*, 7*c*, 7*m* and 7*y*. Thus, each of the different ink jet heads 1*k*, 1*c*, 1*m* and 1*y* has its own individual ink deposit and ink absorbing member. Any number or combination of such ink deposits and ink absorbing members is possible, however.

Figure 8:
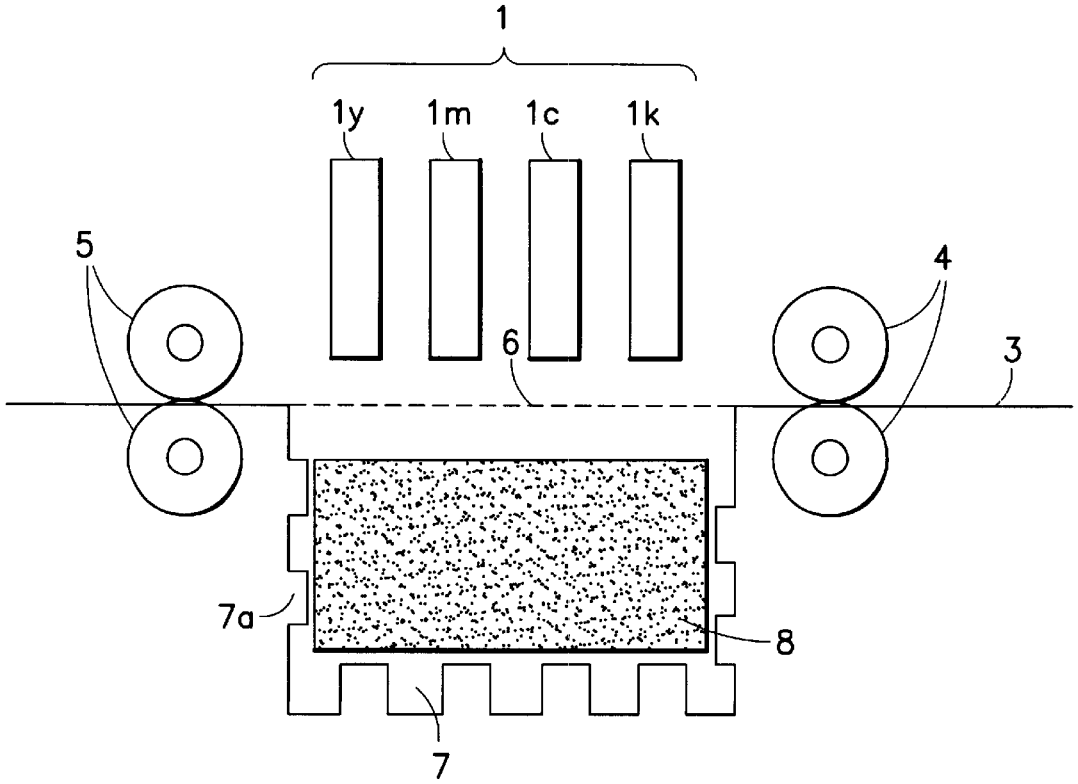
FIG. 8 is a schematic cross-sectional view of an ink jet printing apparatus according to an alternative preferred embodiment of the present invention which is a further modification of the apparatus shown in FIG. 4.

As noted above, it is possible to add the sensors 9 and 10 for sensing electrically, mechanically or otherwise, the presence or absence of a sheet, so as to determine when a nozzle-clog-prevention ink ejection operation can be performed. As seen in FIG. 8, the sensors 9 and 10 have been omitted. This is also possible with the preferred embodiment shown in FIGS. 1–3.

Hereinbelow, an outline of a controller of the ink jet printing apparatus is explained referring to FIG. 9. The controller includes a microcomputer 20 or similar central processing unit (hereinafter referred to as a CPU) that controls almost all of the elements included in the ink jet printing apparatus and serves as a controller for controlling nozzle clog preventing ink ejection explained later in detail. A ROM (read only memory) 21 capable of storing non-alterable data therein and a RAM (random access memory) 22 capable of serving as a working memory or the like for storing alterable data therein are each provided in the ink jet printing apparatus. A color data generator in the form of a color processing circuit 23 capable of generating color data by resolving image data, for example, received from a host computer (not shown) is provided therein. An image memory 24 capable of storing color data generated by resolving the image data, for example, is also included. A parallel inputting/outputting port (hereinafter referred to as a PIO) 25, and an input buffer memory 26 are provided in the ink jet printing apparatus. Further, a gate array (herein after referred to as a GA) or a parallel inputting/outputting port (hereinafter referred to as a PIO) 27, a head driving circuit 28, and a driver 29 or the like connected to a motor 30, are provided in the ink jet printing apparatus. The elements 20–30 of the printing apparatus are preferably connected as shown in FIG. 9 and operate as described below.

Image data serving as image information constituted by multilevel data of color image data received from the host computer is stored in the input buffer memory 26. The so called γ collection process, a UCR (under color removal) process, a half tone process, or the like, is applied to the multilevel data to generate color image data in a binary state. The color image data of the binary state are stored in the image memory 24 as printing data. The printing data are read therefrom in a unit of one line and supplied to the head driving circuit 28 through the PIO port 27. The head 1 or heads 1*k*, 1*c*, 1*m* and 1*y* are selectively activated to eject predetermined mono color ink drops corresponding to the printing data when received.

Figure 9:
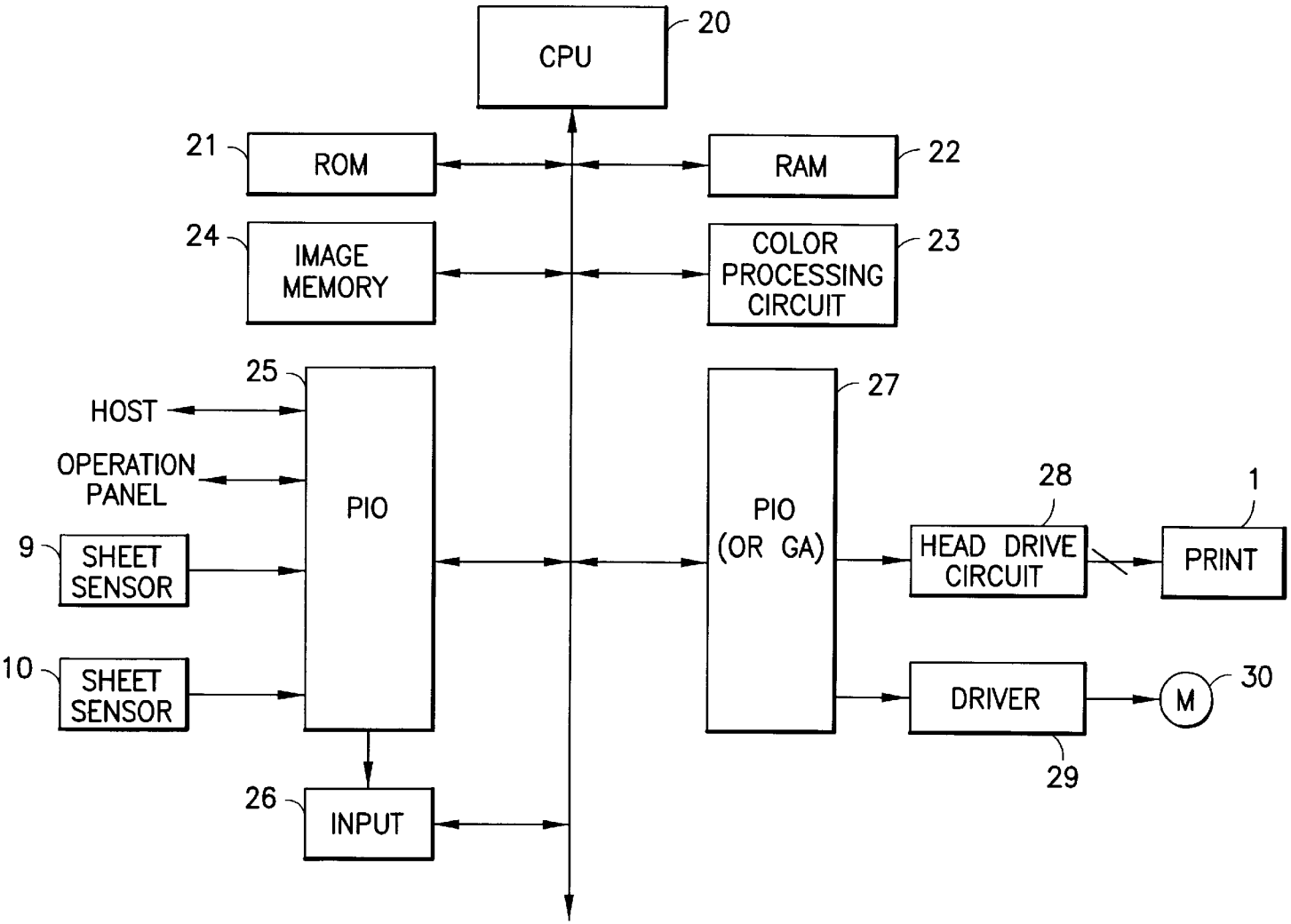
FIG. 9 is a block chart that illustrates a construction of an ink jet printing apparatus of another preferred embodiment of the present invention.

The PIO port 25 receives data from the host computer such as sheet size data, a plurality kinds of instruction data input by an operator through an operation panel, shown in FIG. 9, and detection signals generated by the sheet detectors 9 and 10 that detects a sheet, or the like. Some of predetermined information is sent-to either the host computer or the operation panel through the PIO port 25.

The head driving circuit 28 applies a predetermined voltage having a predetermined waveform to energy-generating elements constituted by an electric-to-mechanic converting element, such as a piezoelectric element, each installed in the driving nozzles of the head 1 or the heads 1*k*, 1*c*, 1*m* and 1*y*, to activate nozzles to eject predetermined mono color ink drops corresponding to image information sent from the PIO port 27. The driver 29 controls the sheet-transporting motor 30 to transport the-sheet through the printing station in a predetermined pitch in response to data sent through the PIO port 27.

Figure 10:
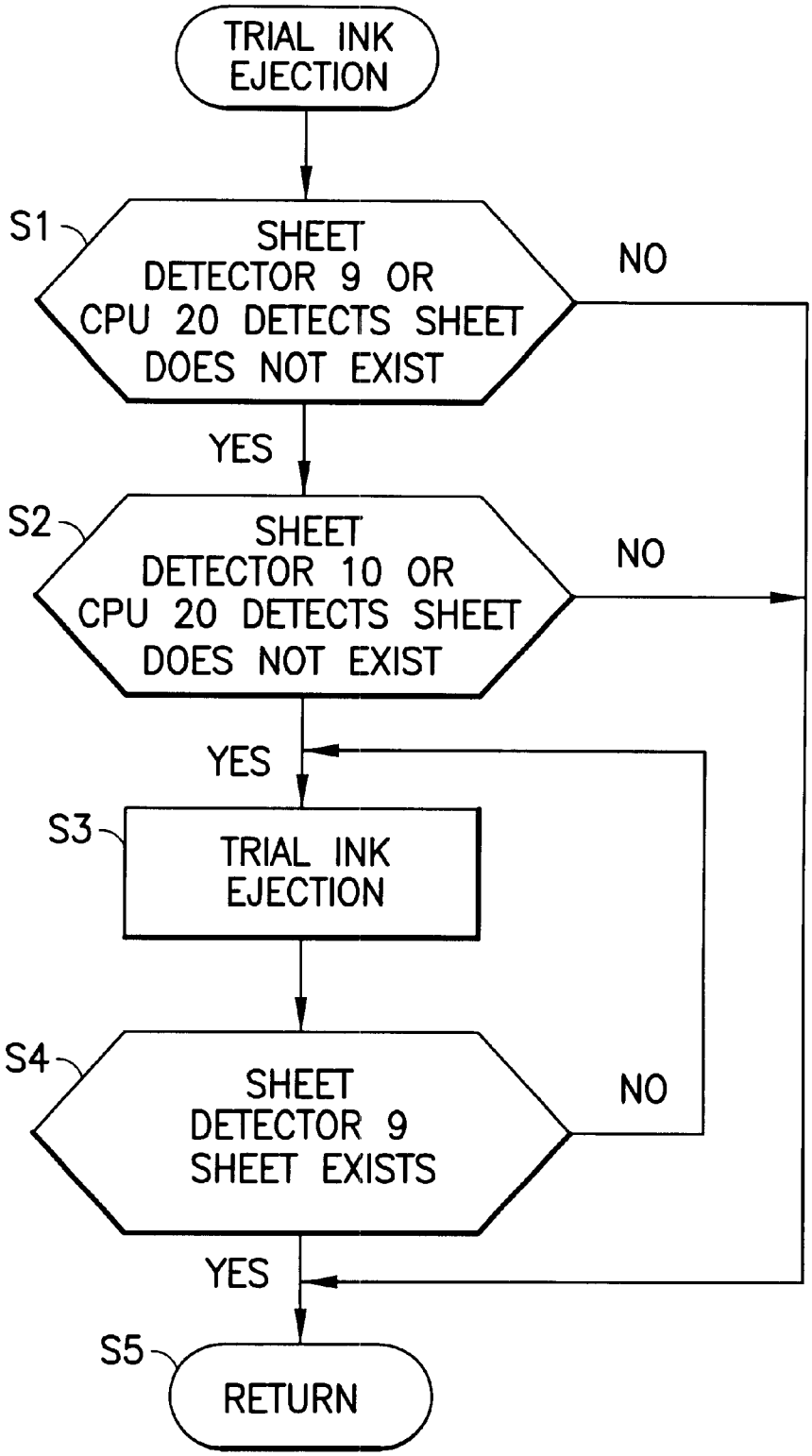
FIG. 10 is a flow chart that illustrates a controlling process of another preferred embodiment of the present invention in which nozzle-clog-preventing ink ejection is executed.

Hereinbelow, an operation of the ink jet printing apparatus as described above is explained in detail referring to FIGS. 10 and 11, and so on. When each of the sheet detectors 9 and 10 does not detect a sheet (step-1 and step-2) or when it has been determined through the elements and CPU 20 shown in FIG. 9 that a sheet is not located between the ink jet head unit 1 and the ink deposit 7, namely, a sheet having an image thereon has been ejected from the ink-jet-printing station, and a new sheet has not yet transported into the printing station, nozzle-clog-preventing ink ejection is executed by predetermined nozzles of the one head 1 or each of the heads 1*k*, 1*c*, 1*m* and 1*y* under the control of the head-driving-circuit 28 (step-3).

When the sheet detector 9 detects a leading edge of the next sheet or the circuit elements and CPU 20 shown in FIG. 9 determine through timing or the like that a sheet is about to be printed and is located between the ink jet print head 1 and the ink deposit 7, for example, the nozzle-clog-preventing ink ejection is stopped (step-4 and step-5). The ink jet head or heads of the ink jet head unit 1 can eject ink drops a prescribed number of times or with a prescribed interval during nozzle-clog-preventing ink ejection.

Figure 11:
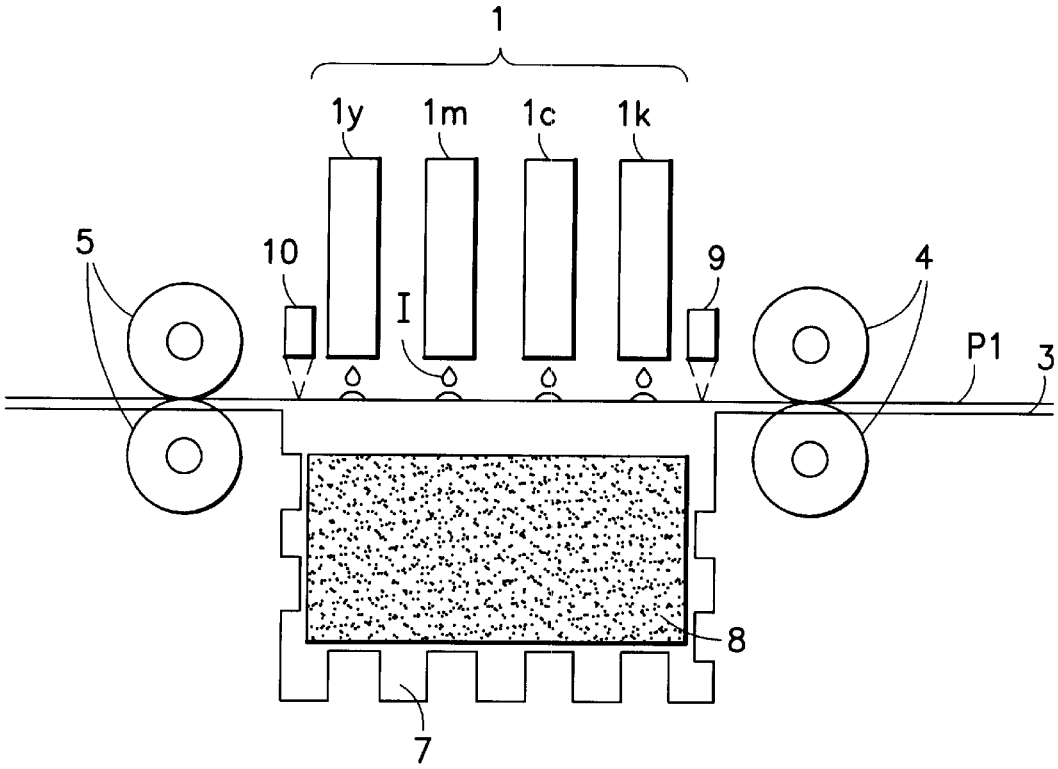
FIG. 11 is a chart for explaining a background ink jet printing process, in which an image is printed on a sheet by ejected ink drops.

Namely, as illustrated in FIG. 11, when a sheet P1 is positioned at a printing station, each of the heads 1*k*, 1*c*, 1*m* and 1*y* is activated to eject mono-color-ink-drops onto a sheet to produce a multi-color-image thereon in response to image data supplied to each of the heads, while the sheet p1 is transported through the printing station.

Figure 12:
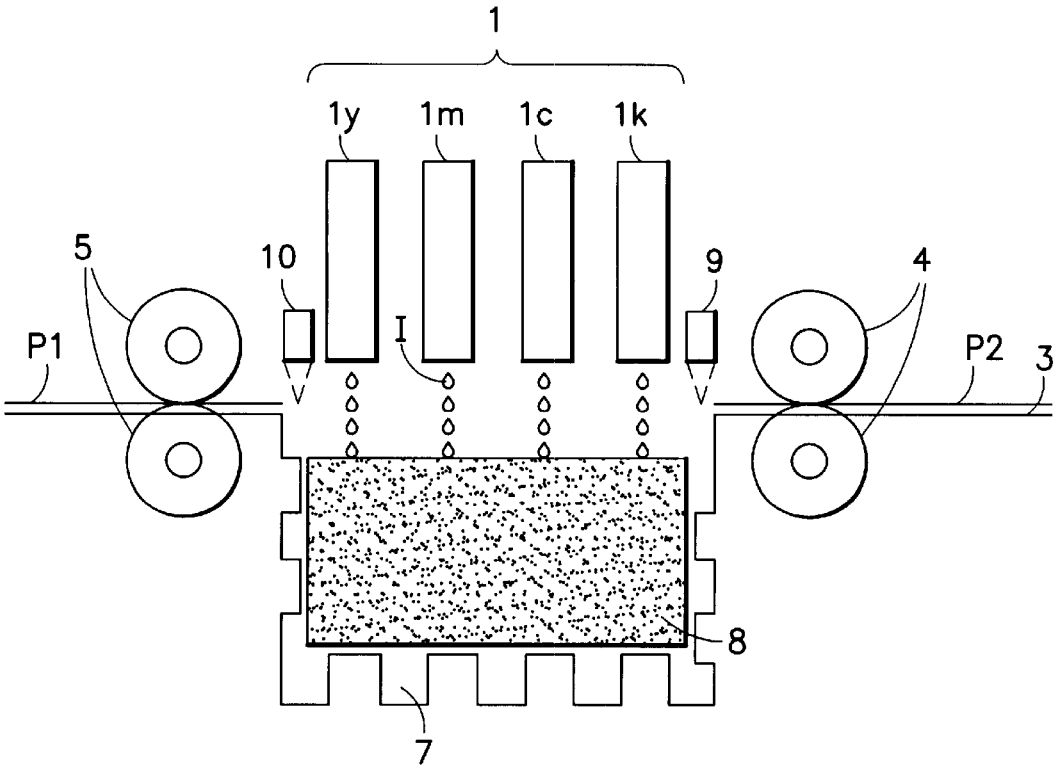
FIG. 12 is a chart for explaining a nozzle clog preventing ink ejection process in which ink drops are ejected into an ink deposit.

When the printing on the sheet P1 has been completed and the sheet P1 is ejected from the printing station, each of the nozzles of the heads 1*k*, 1*c*, 1*m* and 1*y* operates to eject mono-color-ink drops I to perform nozzle-clog-preventing ink ejection, as illustrated in FIG. 12. Each of the ink drops ejected as mentioned above is dropped toward the ink deposit 7 and can be absorbed by the ink absorbing material 8 to be retained therein.

The nozzle-clog-preventing ink ejection preferably takes from about 0.1 seconds to 3 seconds, and accordingly, if both an ejection timing and a feed timing of a sheet are controlled in a prescribed manner, a printing speed is not lowered by the nozzle-clog-preventing ink ejection. A used-ink absorbing material 8 can be manually removed from the ink deposit 7 and exchanged with a new ink absorbing material, when it has retained a predetermined amount of ink therein, or when a user desired. To detect a time when the ink absorbing material 8 has retained the predetermined amount of ink, a counter capable of counting a number of nozzle clog preventing ink-ejecting operations can be provided in the circuit elements shown in FIG. 9.

Further, to determine when the ink absorbing material 8 has retained a predetermined amount of ink, an operation panel illustrated in FIG. 9 can display a mark indicating such a condition to signal an operator to exchange the used ink absorbing material 8 with a new one. The indication that the ink absorbing material 8 has retained the predetermined amount of ink can be executed when a predetermined time period has elapsed from when the new ink absorbing material 8 starts to be used.

Since the ink deposit 7 is disposed below the sheet-transporting path and opposite to the head unit 1, nozzle clog preventing ink ejection can be executed without moving or swinging the head 1 and without printing on a sheet. Thus, the printing speed is not lowered and an image quality is at a very high level. Further, a sheet-transporting path in the printing station is not contaminated with ink drops by the nozzle-clog-preventing ink ejection, and by a malfunction of the print heads, and so on.

Any possible rebound of the ink drops from the ink deposit 7 when the ink jet head ejects ink drops to the ink deposit 7 can be avoided, when the ink drop absorbing member 8 is provided in the ink deposit 7 and absorbs the ink drops. Further, a fine quality of a multi color image can be obtained, since a plurality of heads each ejects different mono color ink such as, black, cyan, magenta and yellow ink, for example.

In one preferred embodiment of the present invention, nozzle-clog-preventing ink ejection is preferably executed at every interval between printed sheets. As a result, all of ink jet printing operations are executed with excellent condition of nozzles and without occurrence of a clog of ink. Accordingly, a quality of an image produced on a sheet is greatly improved. Further, sheets can be prevented from being contaminated with ink drops, since the nozzle clog preventing ejection is prevented whenever the sheet is at a printing station.

Figure 13:
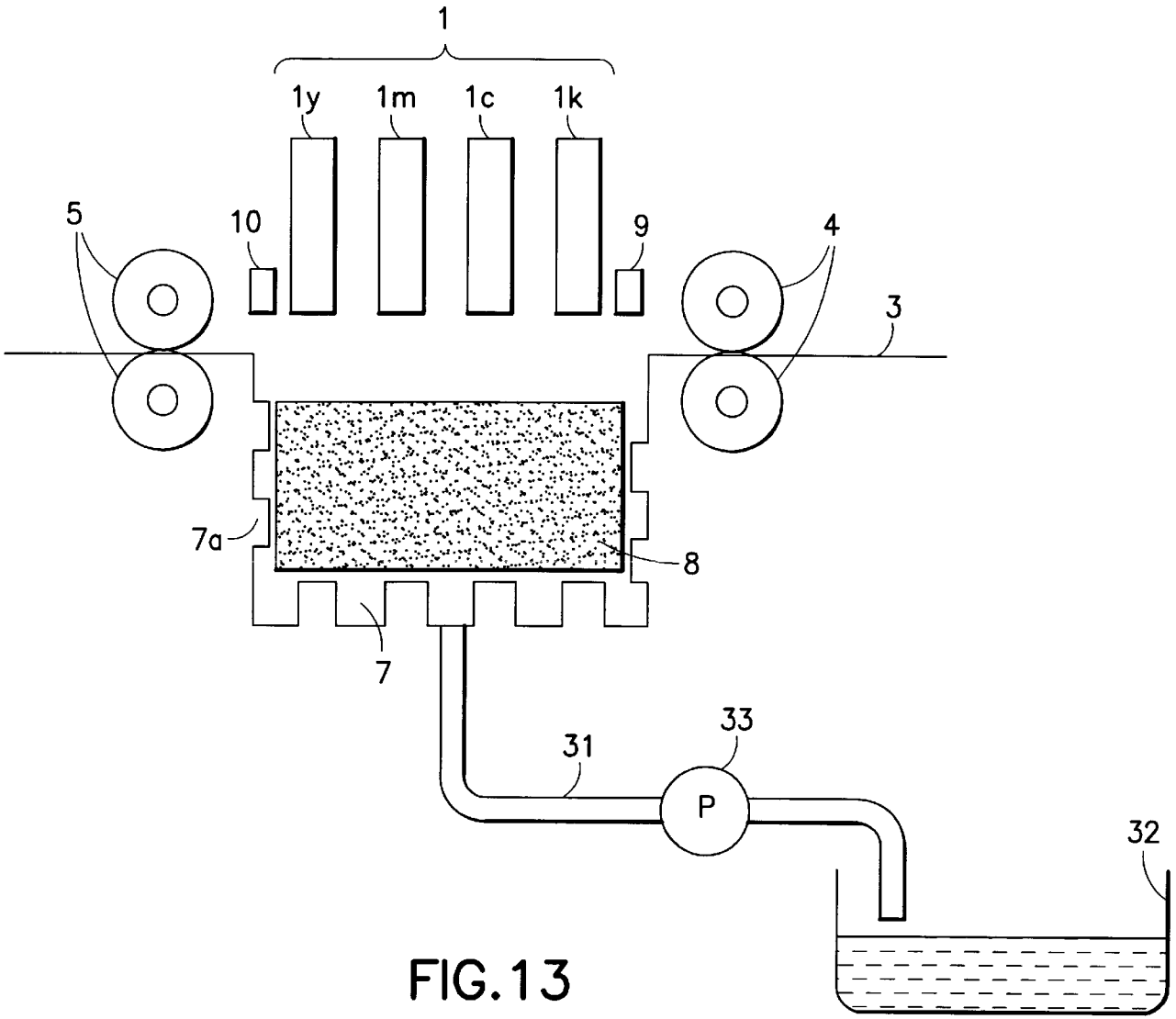
FIG. 13 is a schematic cross-sectional view of another preferred embodiment of the present invention which uses an ink deposit tank.
Figure 14:
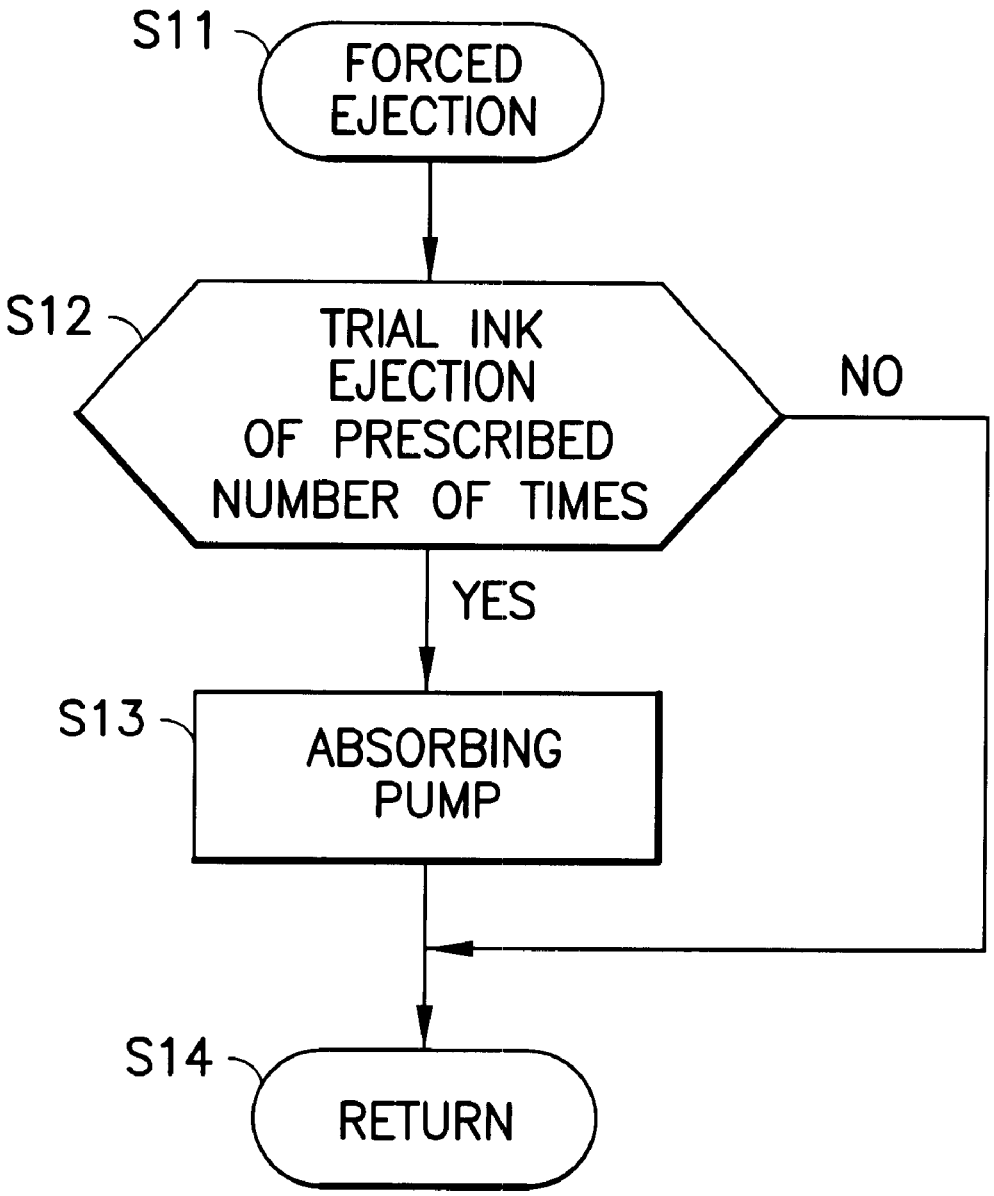
FIG. 14 is a flow chart that illustrates a controlling process related to the preferred embodiment illustrated in FIG. 13, wherein ink is forcibly removed from an ink deposit.

Hereinbelow, a slightly modified preferred embodiment is explained in detail referring to FIGS. 13 and 14. An ink deposit tank 32 is provided and is connected to an ink deposit 7 via a tube 31. A suction pump 33 is disposed in the tube 31 to forcibly remove ink retained in an ink absorbing material 8 to the ink deposit tank 32.

Hereinbelow, an operation of the above mentioned preferred embodiment is explained referring to FIG. 14. A CPU 20 illustrated in FIG. 9 controls the suction pump 33 to periodically operate to remove ink retained in the ink absorbing material 8 by sucking the ink therefrom. The suction pump 33 can operate either when a predetermined number of nozzle clog preventing ink-ejecting operations has been completed or when a predetermined time period has elapsed from when the new ink absorbing material 8 starts to be used. Further, a mono color ink jet printing apparatus that includes a head capable of ejecting only black mono color ink, for example, as shown in FIGS. 1–3, can use an ink deposit for a purpose of executing nozzle-clog-preventing ink ejection in a same manner as mentioned above with respect to FIGS. 13 and 14.

This application is based upon Japanese Patent Application No. 10-8107 filed in the Japanese Patent Office on Jan. 19, 1998, and the entire contents thereof are hereby incorporated by reference. Numerous additional modifications and variations of the present invention are possible in light of the above teachings. It is therefore to be understood that within the scope of the appended claims, the prevent invention may be practiced other than as specifically described herein.

What is claimed is:

1. An ink jet printing apparatus comprising:

at least one print head including a plurality of nozzles arranged to eject ink drops in response to receiving a signal;

a sheet transporting path disposed below said at least one print head, said sheet transporting path configured and adapted to transport one or more individual sheets toward and past said at least one print head;

an ink deposit disposed below said sheet transporting path and arranged to receive ink drops ejected from said nozzles when a nozzle clog-preventing ink ejection is executed;

a print head and operating controller, operatively connected to said at least one print head to control said at least one print head;

a sheet detecting device, comprising at least one of at least one pair of sheet detecting elements, operatively connected with said print head operating controller, wherein said sheet detecting elements are positioned adjacent to said at least one print head, and are configured and adapted to detect that a sheet having an image thereon has been ejected from below said at least one print head, to detect a new sheet that is to be transported under said at least one print head, and to communicate the presence or absence of a sheet between said at least one print head and said ink deposit to said print head operating controller, wherein said print head operating controller is configured and adapted to initiate said nozzle clog-preventing ink ejection by said at least one print head when said sheet detecting device detects that a sheet having an image thereon has been ejected from below said at least one print head, and to stop said nozzle clog-preventing ejection when said sheet detecting device detects that a new sheet is to be transported under said at least one print head.

2. The ink jet printing apparatus as claimed in claim 1, wherein one of said sheet detecting elements is disposed upstream of said at least one print head and the other of said sheet detecting elements is disposed downstream of said at least one print head, the pair of sheet detecting elements being arranged to detect a leading edge and a trailing edge of said sheet, respectively, and a head operating controller arranged to control said at least one print head in such a manner that said at least one print head executes the nozzle clog preventing ink ejection when each of said pair of sheet detecting elements does not detect said sheet.

3. An ink jet printing apparatus as claimed in claim 1, wherein said deposit includes at least one recess which has an opening that is larger than a cross section of said at least one print head in both a width direction and a length direction thereof.

4. An ink jet printing apparatus as claimed in claim 3, wherein said opening is configured to prevent a sheet from being introduced into said at least one recess while the sheet is being moved past said at least one print head.

5. An ink jet printing apparatus as claimed in claim 1, further comprising an ink absorbing member disposed in said ink deposit, the ink absorbing member including a material which is capable of absorbing ink drops ejected from said at least one print head.

6. An ink jet printing apparatus as claimed in claim 5, wherein said ink absorbing member is mounted at least on a bottom surface of said recess.

7. An ink jet printing apparatus as claimed in claim 5, wherein said ink absorbing member is made of a porous material.

8. An ink jet printing apparatus as claimed in claim 1, further comprising an ink-removing device arranged to remove ink from said ink deposit.

9. An ink jet printing apparatus as claimed in claim 8, further comprising an ink-removing controller that controls said ink removing device to remove said ink from said ink deposit at a predetermined time.

10. An ink jet printing apparatus as claimed in claim 9, wherein said predetermined time is determined when a predetermined number of nozzle clog preventing ink ejecting operations have been executed by said at least one print head.

11. A method of preventing or reducing clogging in an ink jet printer print head, the method comprising the steps of:

positioning an ink jet printer print head over an ink deposit in an ink jet printer;

transporting a sheet on a sheet transporting path to a print position between said print head and said ink deposit;

printing an image on said sheet, and ejecting said sheet;

detecting ejection of said sheet with a first sheet detecting element, and communicating said ejection of said sheet to a print head operating controller;

initiating a nozzle clog-preventing ink ejection from said print head into said ink deposit with said print head operating controller upon communicating said ejection of said sheet to said print head operating controller;

detecting a new sheet on said sheet transporting path with a second sheet detecting element before said sheet is transported to said print position, and communicating said detection of said sheet to said print head operating controller; and stopping said nozzle clog-preventing ink ejection from said print head into said ink deposit with said print head operating controller upon communicating said detection of said sheet to said print head operating controller.

12. The method of claim 11, further comprising the step of positioning a detecting device, comprising said first and second sheet detecting elements adjacent said print head, wherein said first sheet detecting element is downstream of said ink jet printer print head, and said second sheet detecting element is upstream of said ink jet printer print head.

* * * * *